US008836314B2

(12) United States Patent
Zhu

(10) Patent No.: US 8,836,314 B2
(45) Date of Patent: Sep. 16, 2014

(54) REFERENCE CURRENT SOURCE CIRCUIT AND SYSTEM

(75) Inventor: Guojun Zhu, Chengdu (CN)

(73) Assignee: IPGoal Microelectronics (Sichuan) Co., Ltd., Chengdu, Sichuan Province (CN)

( * ) Notice: Subject to any disclaimer, the term of this patent is extended or adjusted under 35 U.S.C. 154(b) by 233 days.

(21) Appl. No.: 13/494,994

(22) Filed: Jun. 13, 2012

(65) Prior Publication Data

US 2013/0106392 A1 May 2, 2013

(30) Foreign Application Priority Data

Nov. 2, 2011 (CN) ..... 2011 1 0340937

(51) Int. Cl.
*G05F 3/16* (2006.01)
*G05F 3/20* (2006.01)
*G05F 1/56* (2006.01)

(52) U.S. Cl.
CPC ..... *G05F 1/561* (2013.01)
USPC ..... 323/315; 323/313

(58) Field of Classification Search
USPC ..... 323/313–317; 327/50–56
See application file for complete search history.

(56) References Cited

U.S. PATENT DOCUMENTS

| | | | | |
|---|---|---|---|---|
| 6,587,000 | B2 * | 7/2003 | Oikawa | 330/288 |
| 6,979,990 | B2 * | 12/2005 | Lee | 323/316 |
| 7,301,316 | B1 * | 11/2007 | Pham | 323/281 |
| 7,508,184 | B2 * | 3/2009 | Yen et al. | 323/314 |
| 7,782,094 | B2 * | 8/2010 | Vorenkamp | 327/51 |
| 2002/0017899 | A1 * | 2/2002 | Kato | 323/316 |
| 2005/0146316 | A1 * | 7/2005 | Kim | 323/316 |
| 2008/0231249 | A1 * | 9/2008 | Barrow | 323/315 |

* cited by examiner

*Primary Examiner* — Adolf Berhane
*Assistant Examiner* — Gary Nash

(57) ABSTRACT

A reference current source circuit includes a reference voltage generating module, a voltage buffer, an equivalent resistance, a filter capacitor, a current mirror module and a reference current outputting terminal. The voltage buffer includes an operational amplifier and a first FET. The current mirror module includes a second FET and a third FET. The equivalent resistor includes an oscillator, a fourth FET, a fifth FET and a capacitor connected to the fourth FET and the fifth FET. The oscillator is for generating a clock signal whose frequency is related to a charging and discharging capacitor in the oscillator to control charging and discharging of the capacitor in the equivalent resistance. The reference current outputting terminal is for outputting a reference current only related to a capacitance ratio of the capacitor to the charging and discharging capacitor. A reference current source system is further disclosed.

9 Claims, 3 Drawing Sheets

REFERENCE CURRENT SOURCE CIRCUIT AND SYSTEM

BACKGROUND OF THE PRESENT INVENTION

1. Field of Invention

The present invention relates to a reference current source circuit and its system, and more particularly to a reference current source circuit without externally attached resistors and its system.

2. Description of Related Arts

Referring to FIG. 1, a conventional reference current source circuit is illustrated. The conventional reference depends on a resistor R31 and a reference current value thereof equals a reference voltage Vref of a reference voltage terminal divided by the resistance of the resistor R31, so the reference current value is related to an absolute value of the resistor. In semiconductor arts, an absolute value of a resistor can have a positive or negative deviation of 10%. Thus, in order to generate a highly precise reference current source, it is required to externally attach a resistor or to rectify the resistance value through a calibration mechanism of a back-end test, whereas both add up a cost of a chip.

Based on above analysis, the conventional reference current source needs an externally attached resistor to generate the highly precise reference current source and thus increases the cost of the chip.

SUMMARY OF THE PRESENT INVENTION

Based on above content, it is necessary to provide a reference current source circuit omitting any externally attached resistor and its system.

A reference current source circuit comprises a reference voltage generating module, a voltage buffer connected to the reference voltage generating module, an equivalent resistor connected to the voltage buffer, a filter capacitor connected to the voltage buffer, a current mirror module connected to the voltage buffer and a reference current outputting terminal connected to the current mirror module. The voltage buffer comprises an operational amplifier and a first field-effect transistor (FET) connected to the operational amplifier. The current mirror module comprises a second FET and a third FET connected to the second FET. The equivalent resistor comprises an oscillator, a fourth FET connected to the oscillator, a fifth FET connected to the oscillator and a capacitor connected to the fourth FET and the fifth FET. The oscillator generates a clock signal whose frequency is related to a discharging and charging capacitor in the oscillator to control charging and discharging of the capacitor in the equivalent resistance. The reference current outputting terminal outputs a reference current related to a capacitance ratio of the capacitor to the charging and discharging capacitor.

A reference current source system comprises a reference voltage generating module for generating a reference voltage, a voltage buffer connected to the reference generating module, an equivalent resistor connected to the voltage buffer, a filter capacitor connected to the voltage buffer, a current mirror module connected to the voltage buffer and a reference current outputting terminal connected to the current mirror module. The reference current outputting terminal outputs a reference current only related to the capacitance ratio.

Compared with conventional arts, the reference current source circuit and system of the present invention output the reference current only related to the capacitance ratio, generate the reference current without any externally attached resistance, has a simple structure and also reduce a chip cost.

These and other objectives, features, and advantages of the present invention will become apparent from the following detailed description, the accompanying drawings, and the appended claims.

DETAILED DESCRIPTION OF THE PREFERRED EMBODIMENT

Figure 1:
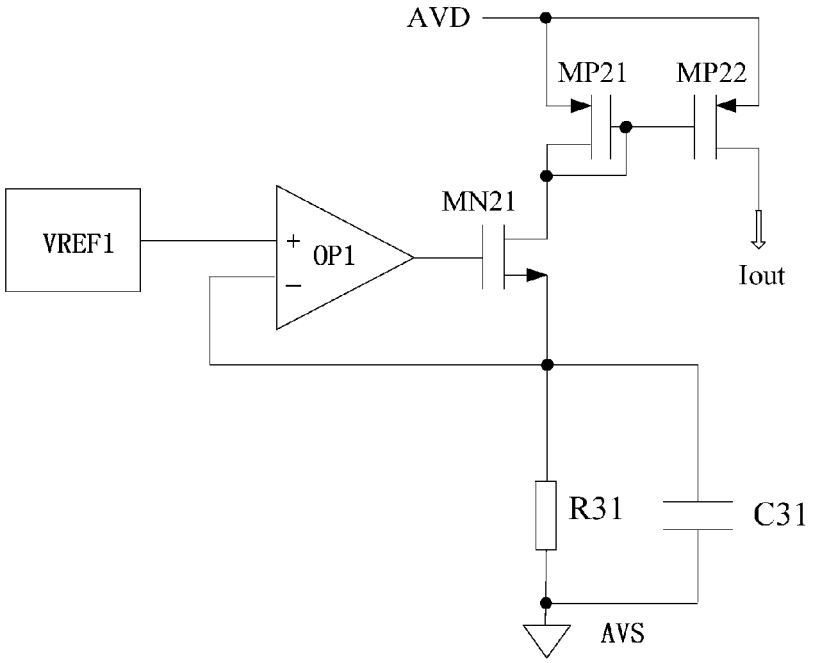
Fig. 1 (prior art)
FIG. 1 is a circuit diagram of a conventional reference current source circuit.
Figure 2:
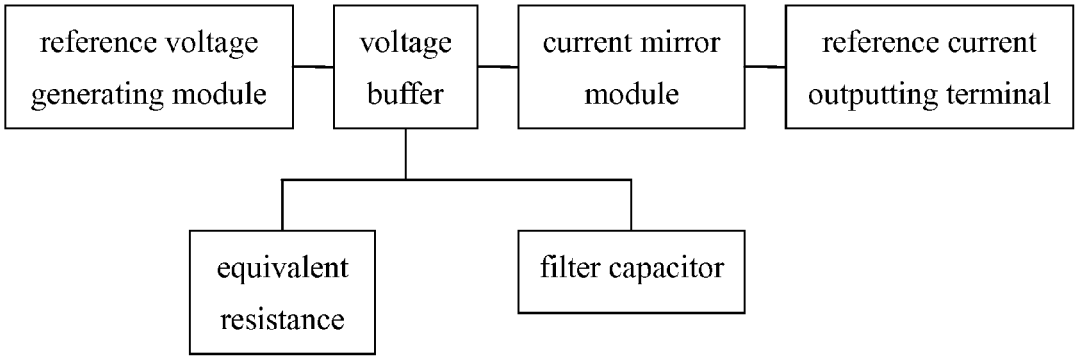
FIG. 2 is a block diagram of a reference current source system according to a preferred embodiment of the present invention.
Figure 3:
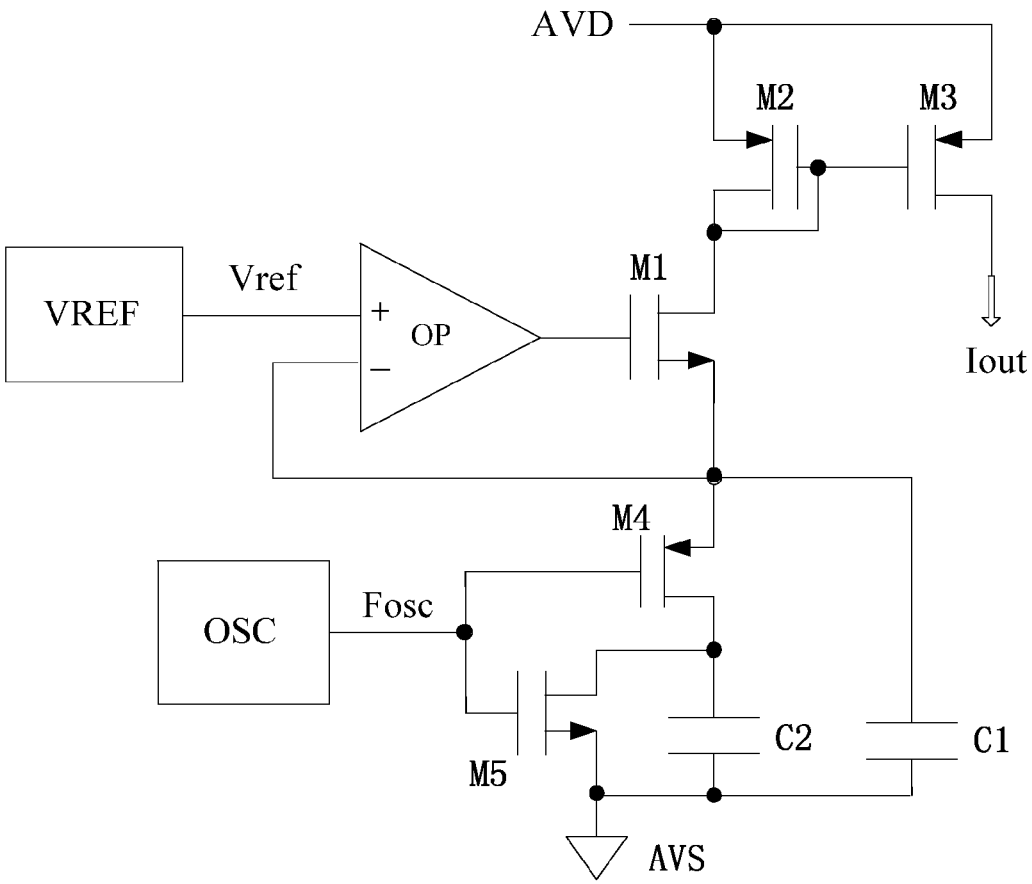
FIG. 3 is a circuit diagram of a reference current source circuit according to the preferred embodiment of the present invention.

Referring to FIGS. 2 and 3 of the drawings, a reference current source circuit and its system according to a preferred embodiment of the present invention are illustrated, comprising a reference voltage generating module VREF, a voltage buffer connected to the reference voltage generating module VREF, an equivalent resistor connected to the voltage buffer, a filter capacitor C1 connected to the voltage buffer, a current mirror module connected to the voltage buffer and a reference current outputting terminal Iout connected to the current mirror module, wherein the voltage buffer comprises an operational amplifier OP and a first FET M1 connected to the operational amplifier OP; the current mirror module comprises a second FET M2 and a third FET M3 connected to the second FET M2; the equivalent resistor comprises an oscillator OSC, a fourth FET M4 connected to the oscillator OSC, a fifth FET M5 connected to the oscillator OSC and a capacitor C2 connected to the fourth FET M4 and the fifth FET M5.

The reference voltage generating module VREF is for generating a reference voltage Vref. The voltage buffer is for equalizing a source electrode voltage of the first FET M1 with the reference voltage Vref. The filter capacitor C1 is for eliminating high-frequency components in the reference current. The oscillator OSC is for generating a clock signal Fosc to control charging and discharging of the capacitor C2. The current mirror module is for outputting the reference current through the reference current outputting terminal Iout.

According to the preferred embodiment of the present invention, specific connections of the reference current source circuit are following. The reference voltage generating module VREF and a non-inverting inputting terminal of the operational amplifier OP are connected; a reversed inputting terminal of the operational amplifier, a source electrode of the first FET M1, a source electrode of the fourth FET M4 and a first terminal of the filter capacitor C1 are all connected with each other; and an outputting terminal of operational amplifier OP and a gate electrode of the first FET M1 are connected with each other. A drain electrode of the first FET M1 is connected to a gate electrode and a drain electrode of the second FET M2 and a gate electrode of the third FET M3; a drain electrode of the third FET M3 and the reference current outputting terminal Iout are connected with each other; and a source electrode of the second FET M2 and a source electrode of the third FET M3 are both connected to a power source terminal AVD. A gate electrode of the fourth FET M4 and a gate electrode of the fifth FET M5 are both connected to the oscillator OSC; a drain electrode of the fourth FET M4 is connected to a drain electrode of the fifth FET M5 and a first terminal of the capacitor C2; and a source electrode of the fifth FET M5, a second terminal of the capacitor C2 and a second terminal of the filter capacitor C1 are all connected to a grounding terminal AVS.

Figure 4:
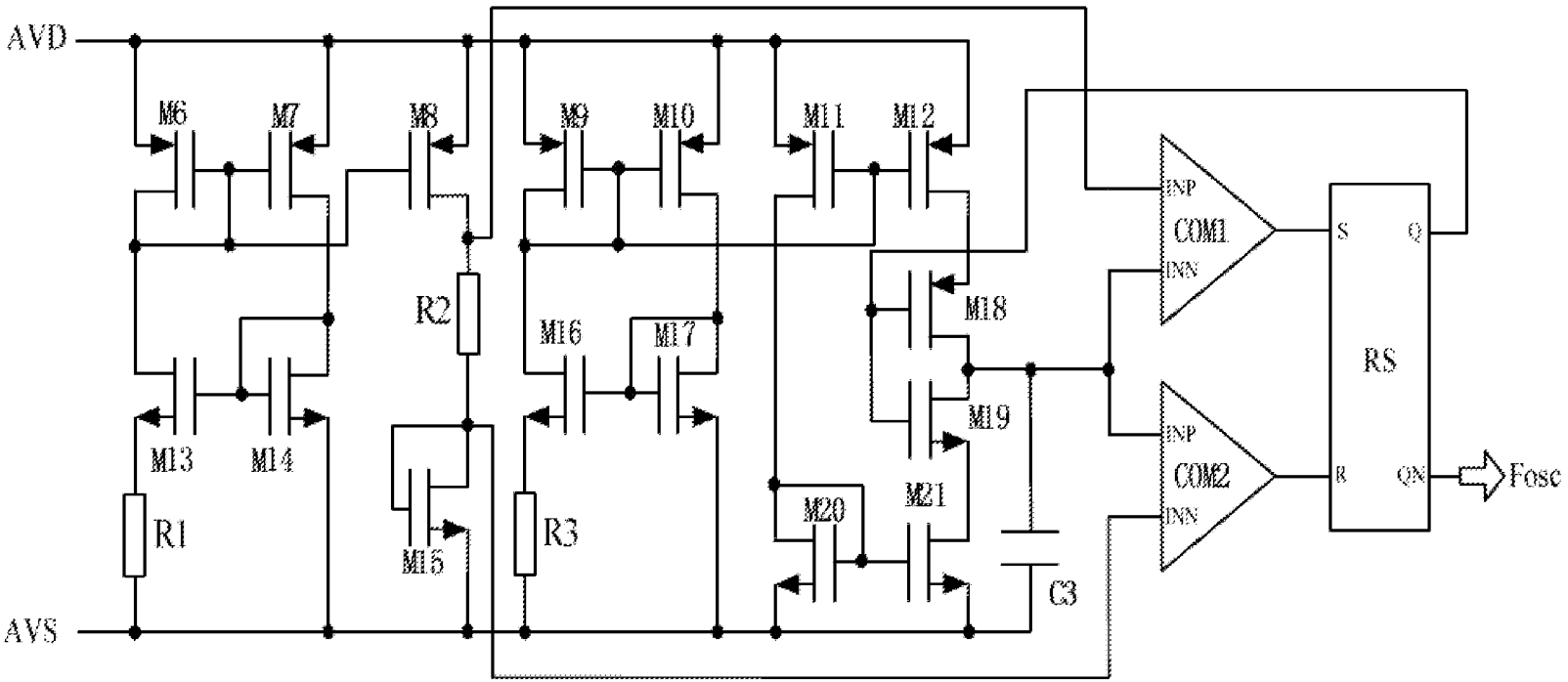
FIG. 4 is a circuit diagram of an oscillator in the reference current source circuit according to the preferred embodiment of the present invention.

Referring to FIG. 4, according to the preferred embodiment of the present invention, a circuit of the oscillator OSC is illustrated, comprising a sixth FET M6, a seventh FET M7, an eighth FET M8, a ninth FET M9, a tenth FET M10, an eleventh FET M11, a twelfth FET M12, a thirteenth FET M13, a fourteenth FET M14, a fifteenth FET M15, a sixteenth FET M16, a seventeenth FET M17, a nineteenth FET M19, a twentieth FET M20, a twenty-first FET M21, a first resistor R1, a second resistor R2, a third resistor R3, a charging and discharging capacitor C3 in an internal part of the oscillator OSC, a first comparer COM1, a second comparer COM2 and a RS flip-flop.

Specific connections of the circuit of the oscillator OSC are following. A gate electrode and a drain electrode of the sixth FET M6, a gate electrode of the seventh FET M7, a gate electrode of the eighth FET M8 and a drain electrode of the thirteenth FET M13 are connected with each other. A drain electrode of the seventh FET M7, a gate electrode and a drain electrode of the fourteenth FET M14 and a gate electrode of the thirteenth FET M13 are connected with each other. A drain electrode of the eighth FET M8 is connected to a first terminal of the second resistor R2 and a non-inverting inputting terminal INP of the first comparer COM1. A gate electrode and a drain electrode of the ninth FET M9, a gate electrode of the tenth FET M10, a gate electrode of the eleventh FET M11, a gate electrode of the twelfth FET M12 and a drain electrode of the sixteenth FET M16 are connected with each other. A drain electrode of the tenth FET M10, a gate electrode and a drain electrode of the seventeenth FET M17 and a gate electrode of the sixteenth FET M16 are connected with each other. A drain electrode of the eleventh FET M11, a gate electrode and a drain electrode of the twentieth FET M20 and a gate electrode of the twenty-first FET M21 are connected with each other. A drain electrode of the twelfth FET M12 and a source electrode of the eighteenth FET M18 are connected with each other. A source electrode of the thirteenth FET M13 and a first terminal of the first resistor R1 are connected with each other. A gate electrode and a drain electrode of the fifteenth FET M15, a second terminal of the second resistor R2 and a reversed inputting terminal INN of the second comparer COM2 are connected with each other. A source electrode of the sixteenth FET M16 and a first terminal of the third resistor R3 are connected with each other. A gate electrode of the eighteenth FET M18 and a gate electrode of the nineteenth FET M19 are both connected to a first outputting terminal Q of the RS flip-flop; and a drain electrode of the eighteenth FET M18, a drain electrode of the nineteenth FET M19 and a first terminal of the charging and discharging capacitor C3 are all connected to a reversed inputting terminal INN of the first comparer COM1 and a non-inverting inputting terminal INP of the second comparer COM2. A source electrode of the nineteenth FET M19 and a drain electrode of the twenty-first FET M21 are connected with each other. An outputting terminal of the first comparer COM1 and a first inputting terminal S of the RS flip-flop are connected with each other; and an outputting terminal of the second comparer COM2 and a second inputting terminal R of the RS flip-flop are connected with each other. A second outputting terminal QN of the RS flip-flop outputs a clock signal Fosc and sends the clock signal Fosc to a gate electrode of the fourth FET M4 and a gate electrode of the fifth FET M5. A source electrode of the sixth FET M6, a source electrode of the seventh FET M7, a source electrode of the eighth FET M8, a source electrode of the ninth FET M9, a source electrode of the tenth FET M10, a source electrode of the eleventh FET M11 and a source electrode of the twelfth FET M12 are all connected to the power source terminal AVD; and a second terminal of the first resistor R1, a source electrode of the fourteenth FET M14, a source electrode of the fifteenth FET M15, a second terminal of the third resistor R3, a source electrode of the seventeenth FET M17, a source electrode of the twentieth FET M20, a source electrode of the twenty-first FET M21 and a second terminal of the charging and discharging capacitor C3 are all connected to the grounding terminal AVS.

According to the preferred embodiment of the present invention, working principles of the reference current source circuit are following.

The thirteenth FET M13 and the fourteenth FET M14 work in saturation regions and a width-length ratio thereof is K1.

The sixth FET M6 and the seventh FET M7 form a first current mirror; based on circuit working states and an omission of body effects of FETs, a current flowing through the first resistor R1 is $$I_1 = \frac{2}{\mu_n C_{ox}\left(\frac{W}{L}\right)_n} * \frac{1}{R1^2} * \left(1 - \frac{1}{\sqrt{K_1}}\right)^2,$$

wherein $\mu_n$ is negative temperature coefficient; $C_{ox}$ is gate oxide capacitance;

$$\left(\frac{W}{L}\right)_n$$

is a width-length ratio of the thirteenth FET M13.

Thus a voltage difference between the two terminals of the third resistor R3 is $$\Delta V = I_1 * R2,$$

and the sixteenth FET M16 and the seventeenth FET M17 work in sub-threshold regions and a width-length thereof is K2.

The ninth FET M9 and the tenth FET M10 form a second current mirror; based on the circuit working states and the omission of body effects of FETs, a charging and discharging current flowing through the charging and discharging capacitor C3 is $$I_2 = \frac{\xi V_T * \ln K_2}{R_2},$$

wherein is a constant related to arts and $V_T$ is a positive temperature coefficient.

Thus a clock frequency of the clock signal Fosc outputted by the oscillator OSC is $$F = \frac{1}{2*\Delta T} = \frac{I_2}{2*\Delta V*C3} = \frac{\mu_n C_{ox}\left(\frac{W}{L}\right)_n \xi V_T * \ln K_2}{4*\left(1-\frac{1}{\sqrt{K1}}\right)^2} * \frac{R1^2}{R2*R3} * \frac{1}{C3},$$

wherein ΔT is a half of a clock cycle; $V_T$ can be completely compensated by designs; and the first resistor R1, the second resistor R2 and the third resistor R3 are matched resistances. And thus the clock frequency of the clock signal Fosc outputted by the oscillator OSC is only inversely proportional to the charging and discharging capacitor C3 and irrelevant to the resistances.

Based on above analysis, the oscillator OSC generates the clock signal Fosc to control charging and discharging of the capacitor C2 and the frequency F of the clock signal Fosc is only related to the charging and discharging capacitor C3, i.e., $$F = \frac{K}{C3},$$

wherein K is a constant.

When the clock signal Fosc is at a low level, the voltage buffer comprising the operational amplifier OP and the first FET M1 charges the capacitor C2 through the fourth FET M4; when the clock signal Fosc is at a high level, the capacitor C2 discharges through the fifth FET M5, and thus a resistance value Ron of the equivalent resistor is $$R_{on} = \frac{1}{C2*F} = \frac{C3}{K*C2}.$$

A reference current I outputted by the reference current outputting terminal Iout is $$I = \frac{Vref}{R_{on}} = \frac{Vref*K*C2}{C3}.$$

Thus the reference current I outputted by the reference current outputting terminal Iout is only related to a capacitance ratio of the capacitor C2 to the charging and discharging capacitor C3 and irrelevant to the resistances, i.e., needs no externally attached resistance.

Based on above analysis, the reference current source circuit and system of the present invention generate a clock signal only related to capacitors through the oscillator to control the charging and the discharging of the capacitors, in such a manner that equivalent impedance only related to a capacitance ratio is formed to generate a reference current.

The reference current source circuit and system of the present invention output the reference current only related to the capacitance ratio. A precision of the capacitance ratio in a semiconductor art is far higher than a precision of an absolute value of the capacitors and the resistances. Thus the reference circuit source circuit and system of the present invention need no externally attached resistor to generate the reference current, have simple structures and reduce costs of chips.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A reference current source circuit comprising a reference voltage generating module, a voltage buffer connected to said reference voltage generating module, an equivalent resistor connected to said voltage buffer, a filter capacitor connected to said voltage buffer, a current mirror module connected to said voltage buffer and a reference current outputting terminal connected to said current mirror module, wherein said voltage buffer comprises an operational amplifier and a first FET connected to said operational amplifier; said current mirror module comprises a second FET and a third FET connected to said second FET; said equivalent resistor comprises an oscillator, a fourth FET connected to said oscillator, a fifth FET connected to said oscillator and a capacitor connected to said fourth FET and said fifth FET; a charging and discharging capacitor is provided in said oscillator; said oscillator is for generating a clock signal whose frequency is only related to said charging and discharging capacitor to control charging and discharging of said capacitor of said equivalent resistance; said reference current outputting terminal is for outputting a reference current related to a capacitance ratio of said capacitor to said charging and discharging capacitor.

2. The reference current source circuit, as recited in claim 1, wherein said reference voltage generating module and a non-inverting inputting terminal of said operational amplifier are connected with each other; a reversed inputting terminal of said operational amplifier is connected to a source electrode of said first FET, a source electrode of said fourth FET and a first terminal of said filter capacitor; and an outputting terminal of said operational amplifier and a gate electrode of said first FET are connected with each other.

3. The reference current source circuit, as recited in claim 2, wherein a drain electrode of said first FET, a gate electrode and a drain electrode of said second FET and a gate electrode of said third FET are connected with each other; a drain electrode of said third FET and said reference current outputting terminal are connected with each other; and a source electrode of said second FET and a source electrode of said third FET are both connected to a power source terminal.

4. The reference current source circuit, as recited in claim 3, wherein a gate electrode of said fourth FET and a gate electrode of said fifth FET are both connected to said oscillator; a drain electrode of said fourth FET is connected to a drain electrode of said fifth FET and a first terminal of said capacitor; and a source electrode of said fifth FET, a second terminal of said capacitor and a second terminal of said filter capacitor are all connected to a grounding terminal.

5. The reference current source circuit, as recited in claim 1, wherein said oscillator further comprises a sixth FET, a seventh FET connected to said sixth FET, an eighth FET connected to said sixth FET and said seventh FET, a ninth FET connected to said eighth FET, a tenth FET connected to said ninth FET, an eleventh FET connected to said ninth FET and said tenth FET, a twelfth FET connected to said eleventh FET, a thirteenth FET connected to said sixth FET and a fourteenth FET connected to said thirteenth FET.

6. The reference current source circuit, as recited in claim 5, wherein said oscillator further comprises a fifteenth FET, a sixteenth FET connected to said ninth FET, a seventeenth FET connected to said sixteenth FET, an eighteenth FET connected to said twelfth FET, a nineteenth FET connected to said eighteenth FET, a twentieth FET connected to said eleventh FET, a twenty-first FET connected to said twentieth FET, a first resistor connected to said thirteenth FET, a second resistor connected to said eighth FET and said fifteenth FET, a third resistor connected to said sixteenth FET, a first comparer connected to said second resistance, a second comparer connected to said first comparer and a RS flip-flop connected to said first comparer and said second comparer.

7. A reference current source system comprising a reference voltage generating module for generating a reference voltage, a voltage buffer connected to said reference voltage generating module, an equivalent resistor connected to said voltage buffer, a filter capacitor connected to said voltage buffer, a current mirror module connected to said voltage buffer and a reference current outputting terminal connected to said current mirror module, wherein said reference current outputting terminal is for outputting a reference current only related to a capacitance ratio;

wherein said voltage buffer comprises an operational amplifier and a first FET connected to said operational amplifier; said current mirror module comprises a second FET and a third FET connected to said second FET; said equivalent resistor comprises an oscillator, a fourth FET connected to said oscillator, a fifth FET connected to said oscillator and a capacitor connected to said fourth FET and said fifth FET; said oscillator comprises a charging and discharging capacitor; said oscillator is for generating a clock signal whose frequency is related to said charging and discharging capacitor to control charging and discharging of said capacitor of said equivalent resistance; and said reference current outputted by said reference current outputting terminal is only related to a capacitance ratio of said capacitor to said charging and discharging capacitor.

8. The reference current source system, as recited in claim 7, wherein said reference voltage generating module and a non-inverting inputting terminal of said operational amplifier are connected with each other; a reversed inputting terminal of said operational amplifier is connected to a source electrode of said first FET, a source electrode of said fourth FET and a first terminal of said filter capacitor; an outputting terminal of said operational amplifier and a gate electrode of said first FET are connected with each other; a drain electrode of said first FET, a gate electrode and a drain electrode of said second FET and a gate electrode of said third FET are connected with each other; a drain electrode of said third FET and said reference current outputting terminal are connected with each other; and a source electrode of said second FET and a source electrode of said third FET are both connected to a power source terminal.

9. The reference current source system, as recited in claim 8, wherein a gate electrode of said fourth FET and a gate electrode of said fifth FET are both connected to said oscillator; a drain electrode of said fourth FET is connected to a drain electrode of said fifth FET and a first terminal of said capacitor; and a source electrode of said fifth FET, a second terminal of said capacitor and a second terminal of said filter capacitor are all connected to a grounding terminal.

* * * * *